United States Patent [19]

Mattei

[11] Patent Number: 4,589,426

[45] Date of Patent: May 20, 1986

[54] CONTINUOUS-ROD CIGARETTE MANUFACTURING MACHINE

[75] Inventor: Riccardo Mattei, Bologna, Italy

[73] Assignee: G.D. Società per Azioni, Bologna, Italy

[21] Appl. No.: 641,848

[22] Filed: Aug. 17, 1984

[30] Foreign Application Priority Data

Sep. 12, 1983 [IT] Italy ..... 3555 A/83

[51] Int. Cl.[4] ..... A24C 5/18; A24C 5/28

[52] U.S. Cl. ..... 131/84.3; 131/84.4

[58] Field of Search ..... 131/84 C, 84.3, 84.4

[56] References Cited

U.S. PATENT DOCUMENTS

| | | | |
|---|---|---|---|
| 3,039,474 | 6/1962 | Korber | 131/84.3 |
| 3,608,562 | 9/1971 | Gomann | 131/84.3 |
| 4,485,826 | 12/1984 | Holzangel | 131/84 C |

*Primary Examiner*—V. Millin

*Attorney, Agent, or Firm*—Marshall, O'Toole, Gerstein, Murray & Bicknell

[57] ABSTRACT

Continuous-rod cigarette manufacturing machine on which provision is made for a first conveyor belt for forming and transferring a continuous stream of tobacco particles, and on which provision is made, along the said first belt, for a shaving device for reducing the stream into sections of different thicknesses alternating at regular intervals. At a so-called loading point, the stream of tobacco is dropped off the first belt onto a strip of cigarette paper on a second, air-permeable conveyor belt for forming a continuous cigarette rod from which a rotary cutter, timed to the shaving device, cuts off single cigarettes. At the said loading point, provision is made for a fixed pressing element, for guiding the stream of tobacco and compacting it on the paper strip, and air-powered means for counteracting the braking and displacing effect exerted by the pressing element on the different-thickness sections of the tobacco stream.

2 Claims, 2 Drawing Figures

Fig.1
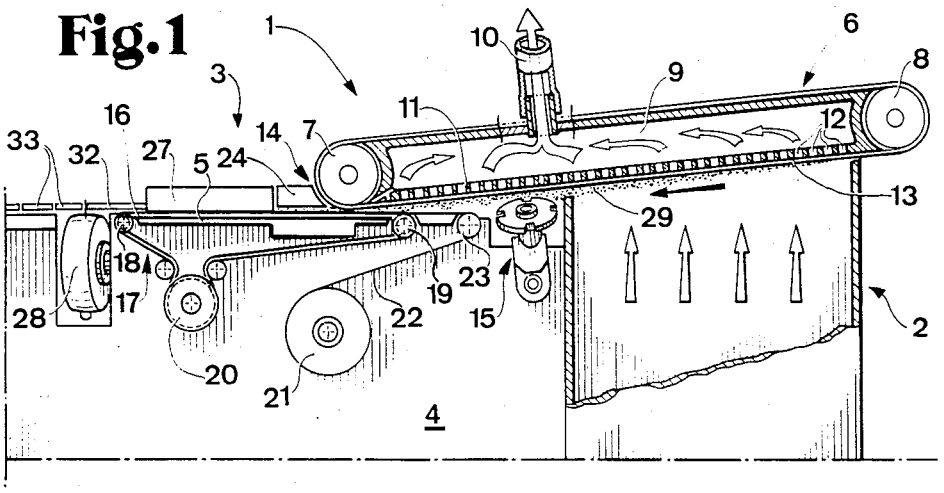
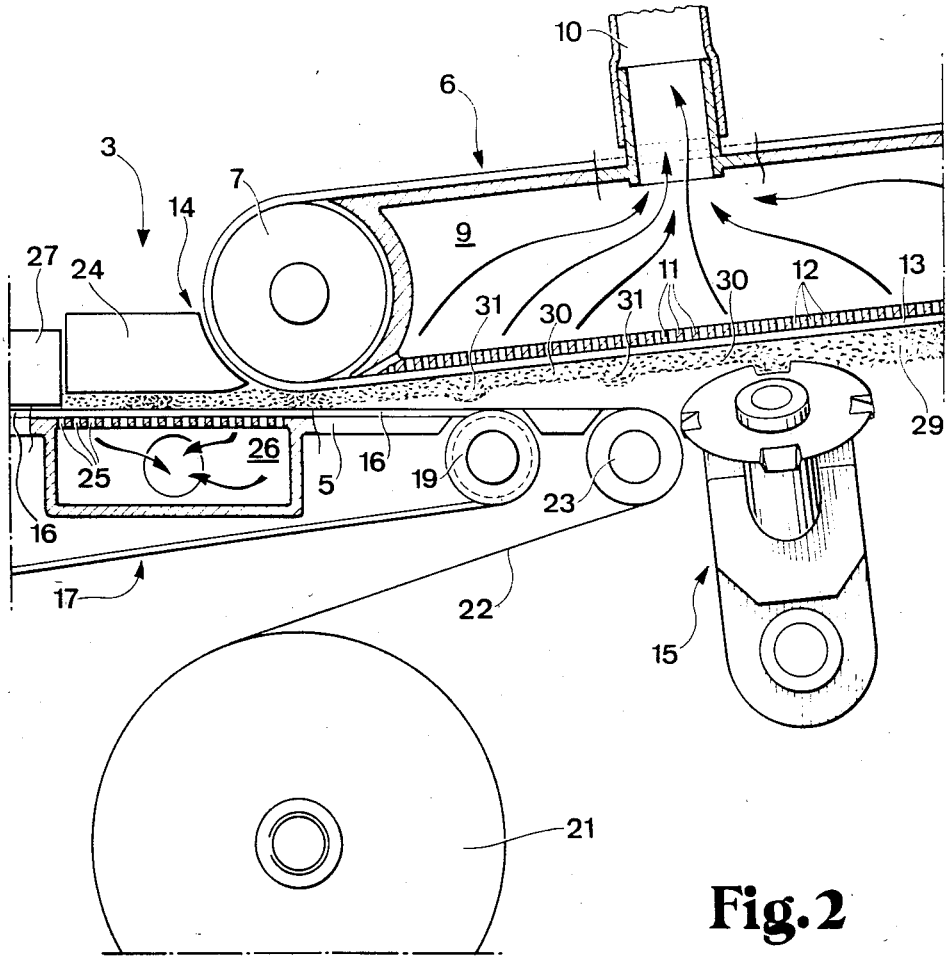
Fig.2

CONTINUOUS-ROD CIGARETTE MANUFACTURING MACHINE

BACKGROUND OF THE INVENTION

The present invention relates to a continuous-rod cigarette manufacturing machine and, more particularly, to the means for forming the so-called continuous cigarette rod.

Cigarette manufacturing machines of the abovementioned type are already known, on which an essentially vertical duct is fed at the bottom from a continuous flow of tobacco particles and is closed off at the top by the bottom branch of a suction conveyor belt, looped round end rollers.

On the suction conveyor belt, a stream of shredded tobacco is formed which, at a point outside the vertical duct, known as the loading station, is dropped on to a strip of cigarette paper adhering to the top branch of a loop conveyor belt running over an essentially horizontal shelf. The conveyor belt forces the paper strip to wrap gradually round the stream of tobacco so as to form a continuous cylinder, the so-called continuous cigarette rod, which, as it comes off the shelf, is cut into single cigarettes by means of a rotary cutter.

Still according to known technology, as it moves between the duct and loading station, the tobacco stream is subjected to the action of a so-called shaving device consisting of a pair of tangent discs with cutting edges shaped so as to form the tobacco stream into two different thicknesses alternating at regular intervals. Once the paper strip has been wrapped round the stream of tobacco, the thicker stream sections are converted into more tightly-packed rod sections. The said rotary cutter is set, in relation to the shaving device, so as to cut the continuous rod at the mid point of the said tightly-packed section.

The purpose behind this is to provide single cigarettes with compact ends, capable of withstanding subsequent manufacturing stages (filter assembly and packing) with no noticeable loss of tobacco.

On known types of manufacturing machines, however, as the stream of tobacco is being transferred from the suction conveyor to the cigarette paper strip at the loading station, it tends to even out in thickness or, at best, the said thicker sections fall out of step in relation to the rotary cutter.

The reason underlying this drawback can be found in the withholding action exerted by a fixed element, known as a pressure element, over the rod forming shelf. The function of the said element is to control the tobacco stream, as it is dropped off the suction conveyor, and to guide and compact it, once it is deposited on the paper strip, so as to enable subsequent formation of the continuous cigarette rod.

Consequently, to prevent the rod from being cut outside the more tightly-packed sections, and consequent production of extremely poorly-packed cigarettes, the contour on the shaving discs is shaped so as to oversize the said tightly-packed sections.

Obviously, however, such a corrective measure also results in a considerable increase in the amount of tobacco required for manufacturing the cigarettes.

SUMMARY OF THE INVENTION

The aim of the present invention is to overcome the abovementioned drawbacks by providing for perfect timing between the more tightly-packed sections and the rotary cutter, so as to reduce tobacco consumption to an absolute minimum.

With this aim in view, the present invention relates to a continuous-rod cigarette manufacturing machine comprising a first suction conveyor belt for forming and transferring a continuous stream of tobacco; comprising a shaving device for reducing the said stream into sections of different thicknesses alternating at regular intervals; comprising a second, air-permeable conveyor belt running over a shelf on the said machine and supporting a strip of cigarette paper fed with the said tobacco stream, at a point known as a loading point, by the said first conveyor belt; comprising means for wrapping the said paper strip round the said tobacco stream for forming a continuous cigarette rod; comprising a rotary cutter operating in strict time with the said shaving device; and finally, comprising a fixed pressing element located over the said loading point and acting on the said tobacco stream; characterised by the fact that, at the said loading point, it comprises air-powered suction means acting on the said tobacco stream, so as to counteract the braking action exerted by the said pressing element.

BRIEF DESCRIPTION OF THE DRAWINGS

A preferred arrangement of the present invention will now be decribed, by way of a non-limiting example, with reference to the attached drawings, in which:

FIG. 1 shows a partially sectioned front view of the machine according to the present invention;

FIG. 2 shows a detail of the FIG. 1 machine.

DETAILED DESCRIPTION OF THE INVENTION

Number 1 in FIG. 1 indicates a continuous-rod cigarette manufacturing machine.

The machine is divided into two parts, i.e. an essentially vertical duct or flue, 2, and a section, 3, of which forms part base 4 limited at the top by shelf 5.

Section 3 is designed for forming a continuous cigarette rod and cutting it into single cigarettes.

Duct 2 and section 3 are passed over and connected to each other by a suction conveyor belt, 6, looped round clockwise end rollers 7 and 8. Within the loop formed by belt 6, provision is made for a chamber, 9, connected by duct 10 to a suction source (not shown) limited at the bottom by panel 11 with through holes or slots 12.

The bottom branch, 13, of belt 6, in sliding contact with panel 11, closes off the outlet of duct 2 and extends its leftward end up to point 14, called the loading point, where the tobacco is supplied to section 3.

Next to branch 13, outside duct 2 and upstream from loading point 14, provision is made for a device, called a shaving device, indicated as a whole by 15.

Loading point 14 is located at the junction of branch 13 with top branch 16, running over shelf 5, of a fabric conveyor belt, 17, air-permeable, looped round end rollers 18 and 19 and powered by anticlockwise roller 20.

Number 21 indicates a coil from which a strip, 22, of cigarette paper is unwound and detoured, by a transmission roller, 23, on to branch 16 of belt 17.

Over loading point 14, provision is made for a fixed pressing element, 24.

At loading point 14 (FIG. 2), shelf 5 is provided, underneath the input end of branch 16, with a series of holes, 25, communicating with air-powered suction means consisting of a suction chamber, 26, inside base 4 and connected to a suction source not shown.

Section 3 also includes wrapping or guide means, 27, over shelf 5, for forming the continuous cigarette rod, and a rotary cutter, 28, on a level with shelf 5 and downstream from the output end of branch 16.

With machine 1 in operating mode, known means (not shown) feed the bottom end of duct 2 with a continuous flow of tobacco particles.

By means of an upward draught generated by a compressed air source not shown, the said particles are blown up duct 2, so as to cling to branch 13 and so accumulate to form a continuous layer or stream, 29, of essentially uniform thickness.

Outside duct 2, the tobacco stream, 29, clinging to branch 13 is shaved by shaving device 15 (see also FIG. 2). The outcome of the said shaving operation is to produce a stream of tobacco in which sections of given height and thickness, 30, alternate at regular intervals with shorter, thicker sections, 31.

At loading point 14, tobacco stream 29, no longer held by suction conveyor 6, is deposited on to paper strip 22 clinging to top branch 16. At this transfer stage, the function of pressing element 24 is to control and guide tobacco stream 29 and to compact it lightly after it has been deposited on to paper strip 22.

The suction force generated by chamber 26 passes through fabric belt 17 and cigarette paper strip 22, also porous enough to allow air through, so as to exert suction on tobacco stream 29.

The said suction force is regulated in such a manner as to eliminate or effectively counteract the braking action of pressing element 24 or any friction created during transfer.

Paper strip 22 is forced by belt 17 to wrap gradually round tobacco stream 29 so as to form, with the help of guide means 27, a continuous cigarette rod, 32, which is then cut into single cigarettes, 33, by rotary cutter 28. Consequently, in conformance with the aims already mentioned, the thicker sections, 31, retain their correct position on shelf 5 and are converted, after the formation of continuous rod 32, into tightly-packed sections for cutting by cutter 28.

I claim:

1. A continuous-rod cigarette manufacturing machine (1) comprising a first suction conveyor belt (6) for forming and transferring a continuous stream (29) of tobacco; a shaving device (15) for reducing the stream (29) into sections (30, 31) of different thicknesses alternating at regular intervals; a second, air-permeable conveyor belt (17) running over a shelf (5) on the said machine (1) and supporting a strip (22) of cigarette paper fed with the said tobacco stream, at a point (14) known as a loading point, by the first conveyor belt (6); means (27) for wrapping the paper strip (22) around the tobacco stream (29) for forming a continuous cigarette rod (32); a rotary cutter (28) operating in strict time with the shaving device (15); a fixed pressing element (24) located over the loading point (14) and acting on the tobacco stream (29); and at the loading point (14), air-powered suction means (26) acting on the said tobacco stream (29), so as to counteract braking action exerted by the pressing element (24).

2. A cigarette manufacturing machine according to claim 1, in which the air-powered means comprises a suction chamber (26) connected to the second conveyor belt (17) on the side of the shelf (5).

* * * * *